US009134100B2

(12) United States Patent
Martinez-Tovar et al.

(10) Patent No.: US 9,134,100 B2
(45) Date of Patent: Sep. 15, 2015

(54) SURFACE MOUNTABLE SEMICONDUCTOR BRIDGE DIE

(75) Inventors: Bernardo Martinez-Tovar, Albuquerque, NM (US); Craig J. Boucher, Simsbury, CT (US)

(73) Assignee: ENSIGN-BICKFORD AEROSPACE & DEFENSE COMPANY, Simsbury, CT (US)

( * ) Notice: Subject to any disclaimer, the term of this patent is extended or adjusted under 35 U.S.C. 154(b) by 1313 days.

(21) Appl. No.: 12/754,639

(22) Filed: Apr. 6, 2010

(65) Prior Publication Data

US 2010/0258914 A1 Oct. 14, 2010

Related U.S. Application Data

(60) Provisional application No. 61/168,650, filed on Apr. 13, 2009.

(51) Int. Cl.
*F42B 3/13* (2006.01)
*F42B 3/12* (2006.01)

(52) U.S. Cl.
CPC ... *F42B 3/13* (2013.01); *F42B 3/12* (2013.01); *F42B 3/124* (2013.01)

(58) Field of Classification Search
CPC ..... F42B 3/12; F42B 3/13; F42B 3/124
USPC ..... 102/200, 202.5, 202.7, 202.8, 202.9, 102/202.14
See application file for complete search history.

(56) References Cited

U.S. PATENT DOCUMENTS

| | | | | |
|---|---|---|---|---|
| 4,257,061 | A * | 3/1981 | Chapel et al. | 257/735 |
| 5,682,008 | A * | 10/1997 | Chervinsky et al. | 102/202.7 |
| 5,912,427 | A * | 6/1999 | Willis et al. | 102/202.8 |
| 6,054,760 | A | 4/2000 | Martinez-Tovar et al. | |
| 7,328,657 | B2 | 2/2008 | Martinez-Tovar | |

FOREIGN PATENT DOCUMENTS

| | | | |
|---|---|---|---|
| DE | 19702118 | C1 * | 3/1998 |
| DE | 10211348 | A1 * | 10/2003 |

* cited by examiner

*Primary Examiner* — James S Bergin
(74) *Attorney, Agent, or Firm* — Cantor Colburn LLP

(57) ABSTRACT

A semiconductor bridge die may have an "H-design" or "trapezoidal" configuration in which a center bridge segment is flanked by one or more angled walls on each side of the bridge segment. Each wall is plated with a conductive material, thereby providing a continuous conductive path across the top surface of the die. A bottom surface of the die may be connected to a top surface of a header by epoxy in various configurations. The plated angled walls facilitate the solderable connection of the walls to a plated top surface of each of several pins on a top surface of the header, thereby providing a continuous electrical connection between the pins and the die. Also, a method is provided for manufacturing a semiconductor bridge die in accordance with the various embodiments of the die.

10 Claims, 13 Drawing Sheets

FIG. 2A
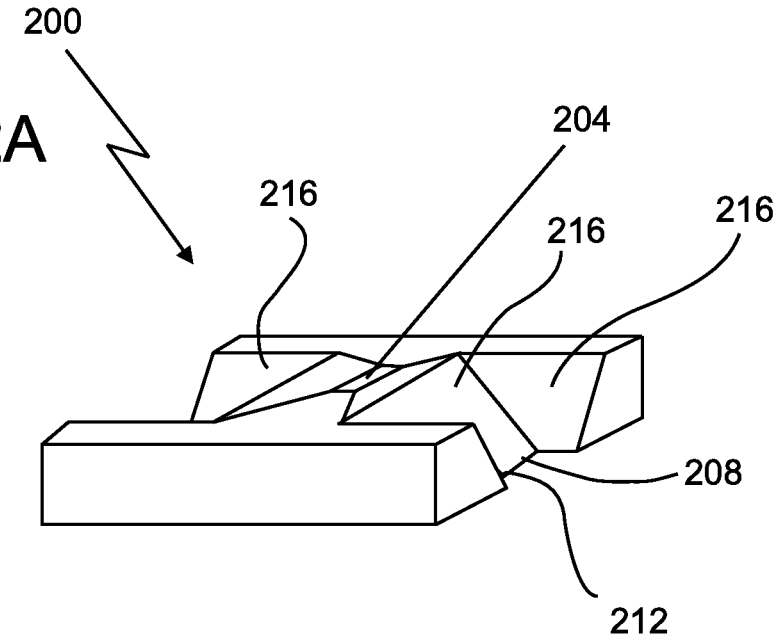
FIG. 2B
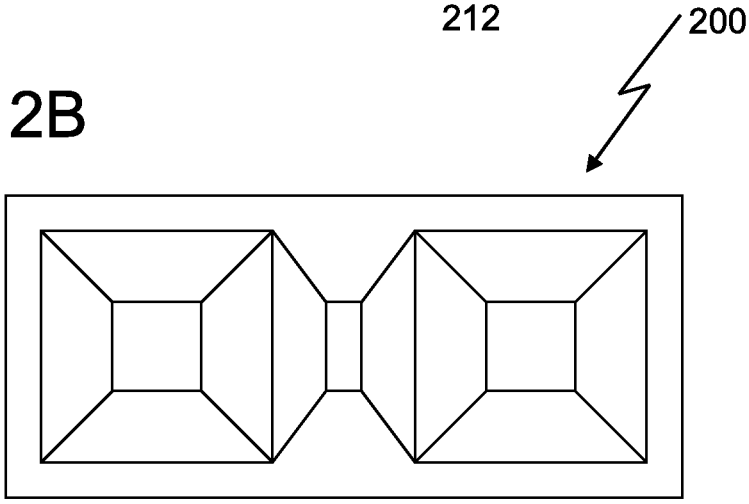
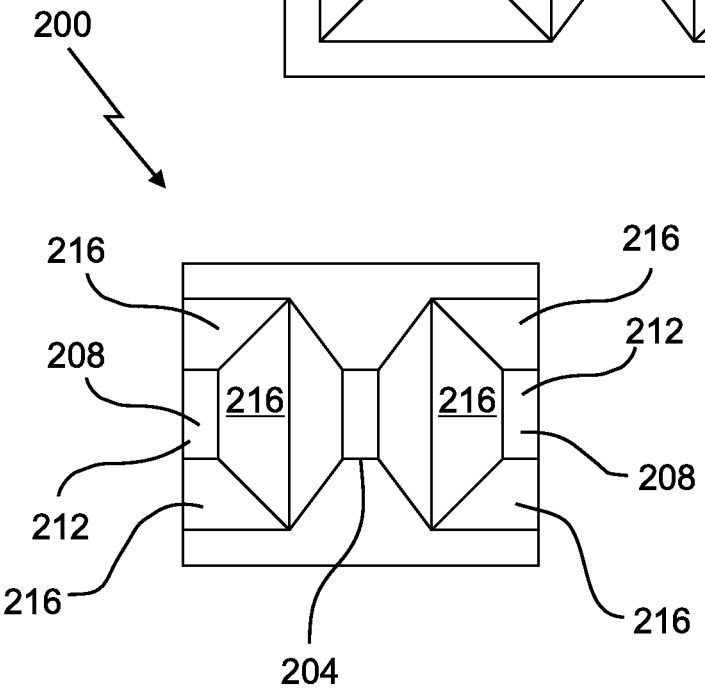
FIG. 2C

FIG. 5A
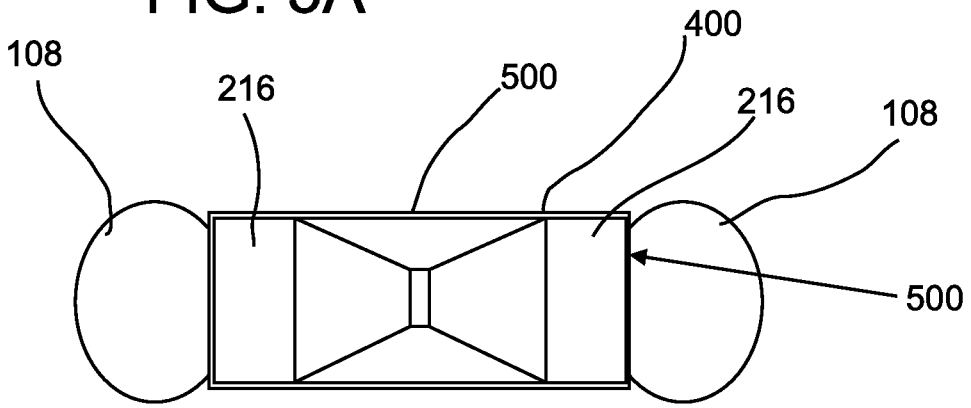
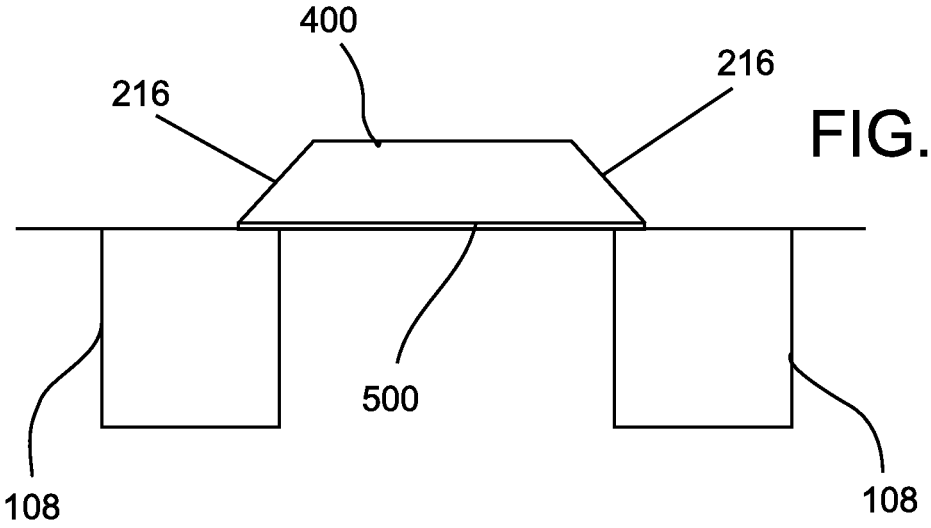
FIG. 5B
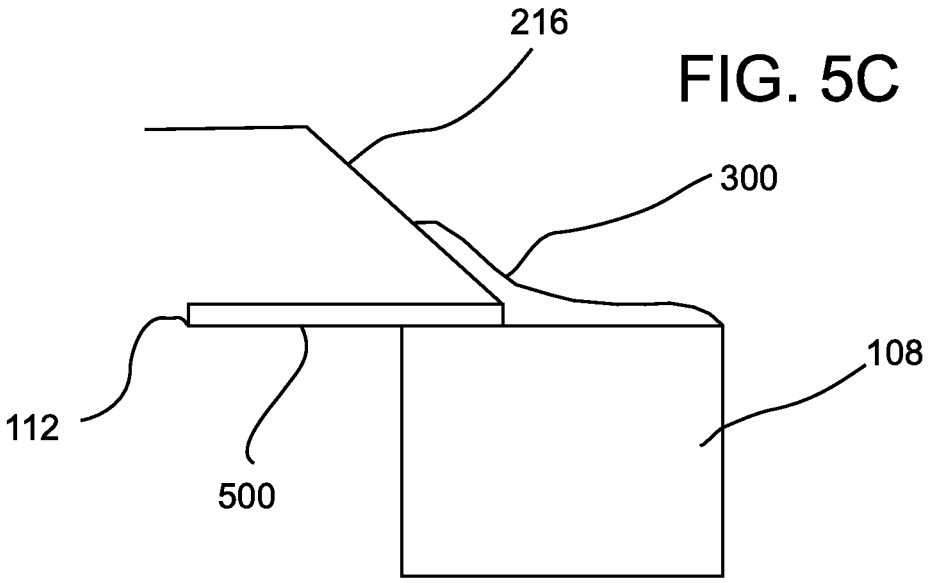
FIG. 5C

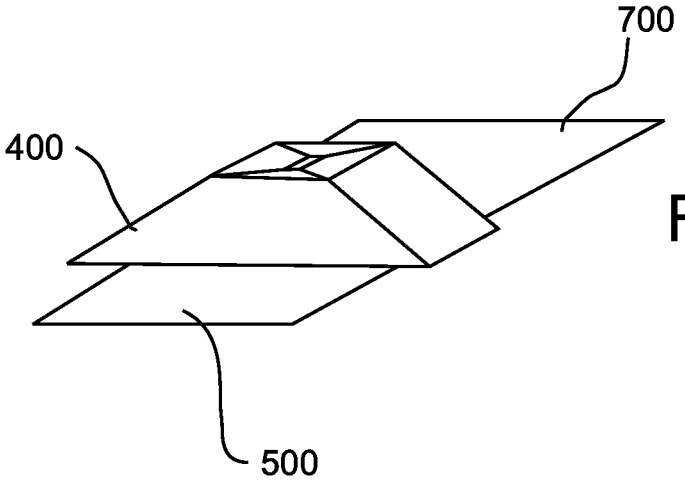
FIG. 7
FIG. 8A
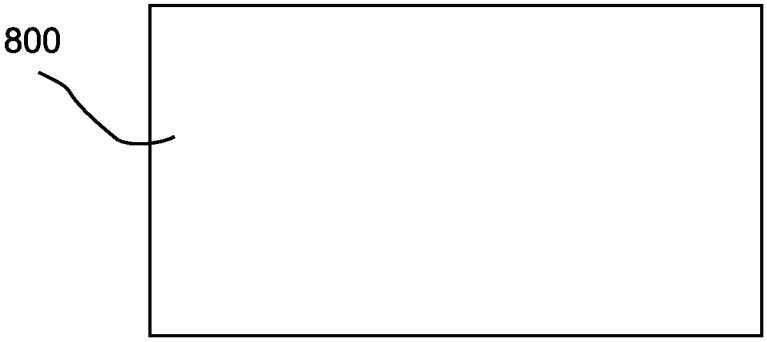
FIG. 8B
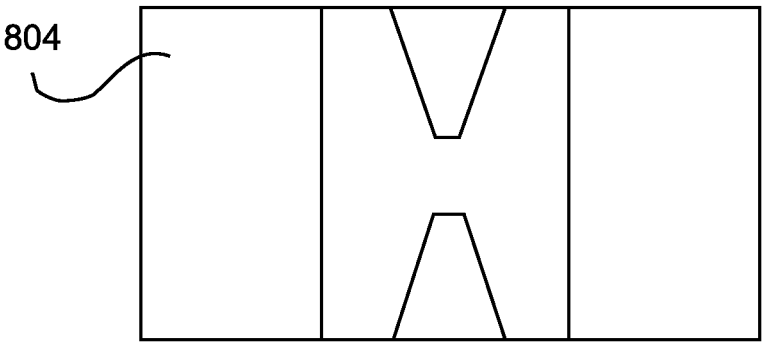

SURFACE MOUNTABLE SEMICONDUCTOR BRIDGE DIE

CROSS-REFERENCE TO RELATED APPLICATIONS

This application claims the benefit of U.S. Provisional Application Ser. No. 61/168,650, entitled "Surface Mountable Semiconductor Bridge Die", filed Apr. 13, 2009, which is incorporated herein by reference in its entirety.

FIELD OF THE INVENTION

The present invention relates in general to semiconductor bridges and, in particular, to a surface mountable, semiconductor bridge die having rectangular, plated-through "half-holes" which facilitate the solderable connection of the semiconductor bridge die to a header.

BACKGROUND OF THE INVENTION

A semiconductor bridge ("SCB") die device has typically been configured to include a pair of conductive lands connected together by a narrower conductive bridge segment. The bridge segment may be formed from doped or undoped silicon, either alone or having an upper layer of a metal such as tungsten or titanium disposed thereover. The lands may also comprise silicon, oftentimes covered with a layer of, e.g., aluminum. Other configurations of the die exist in the art. The conductive lands are commonly connected to a source of electrical energy (e.g., an active power source or a stored charge device such as a capacitor). For use as an explosive initiator or igniter, the bridge segment is typically placed in close physical contact with an explosive charge (e.g., a pyrotechnic material charge). In various embodiments of these devices, an electrical current passing through the bridge causes plasma to form from the electrically activated bridge material, wherein the plasma subsequently initiates or ignites the explosive charge. The explosive charge may be connected by, e.g., a shock tube, to a detonator device that detonates upon initiation or ignition of the explosive charge by the SCB device.

In addition, the SCB die is typically connected to a header device. The header may comprise ceramic, glass, metal or other suitable material. The bottom surface of the SCB die may connect to the top surface of the header by, e.g., a soldered connection or epoxy. Besides this physical connection of the SCB die to the header, an electrical connection from the electrically conductive SCB die to pins (typically two pins) on the header also exists. The header pins are then connected to the electrical power source.

Prior art SCB devices typically utilize bondwires (e.g., 5 mils in diameter) to make an electrical connection from the top surface of the die (i.e., from the metallized conductive lands on the die) to the pins or other suitable contact areas on the header. However, issues regarding the use of bondwires may include bondwire cutoff smearing aluminum across the glass seal which surrounds the pin to be wirebonded, sub-optimal bondwire configuration for relatively small geometry applications, minimum powder load requirements to assure the bondwires do not touch the output cup, added header cost due to the unique features required for wirebonding, electrostatic discharge issues, and with respect to high volume applications the cost of capital equipment required for wirebonding at high speed.

For these and other reasons, it is known to eliminate the bondwires and use some type of electrically conductive surface connection between the bottom surface of the SCB die and the top surface of the header. Such a surface mounted SCB die enables igniters with relatively smaller charges to be readily manufactured since the header can be made with a smaller diameter and the minimum powder bed above the die can be reduced, as there are no bondwires that might contact the output cup. However, these and other common known approaches for connecting the SCB die to the header without bondwires (e.g., submounts and wraparound metallization) are relatively limited in their applicability, for example, in that they require relatively tightly controlled header dimensions. Also, these methods are of relatively high cost and not easily manufacturable.

Vertical holes have been manufactured but fabricating die with metal on the insides of the holes has proven problematic. What is needed is a tapered or "slope-sided" SCB die and method for making such a die wherein the resulting die is relatively more easily solderable to the header through use of a surface mounting technique without the use of bondwires, the connection between the die and the header being relatively more reliable, the dimensional requirements of the header are relaxed to a certain degree, and the manufacture of the SCB die and header, along with the soldering of the die to the header, are all of relatively lower cost.

SUMMARY OF THE INVENTION

According to an embodiment of the invention, a semiconductor bridge die has an "H-design" configuration in which a center bridge segment is flanked by three angled or sloped walls on each side of the bridge segment. Each wall is plated with a conductive material, thereby providing a continuous conductive path across the top surface of the die. A bottom surface of the die may be connected to a top surface of a header by epoxy in various configurations. The plated angled walls facilitate the solderable connection of the walls to a plated top surface of each of several pins on a top surface of the header, thereby providing a continuous electrical connection between the pins and the die.

According to another embodiment of the invention, a semiconductor bridge die has a "trapezoidal" design configuration in which a center bridge segment is flanked by a single angled or sloped wall on each side of the bridge segment. Each wall is plated with a conductive material, thereby providing a continuous conductive path across the top surface of the die. A bottom surface of the die may be connected to a top surface of a header by epoxy in various configurations. The plated angled walls facilitate the solderable connection of the walls to a plated top surface of each of several pins on a top surface of the header, thereby providing a continuous electrical connection between the pins and the die.

According to another aspect of the invention, a method is provided for manufacturing a semiconductor bridge die in accordance with the various embodiments of the die. For example, a difference between the "H-design" and the "trapezoidal" design configurations of the corresponding dies lies in a dicing step in which more of the "trapezoidal" die is removed by dicing than in the "H-design" die configuration.

BRIEF DESCRIPTION OF THE DRAWINGS

The various embodiments of the present invention can be understood with reference to the following drawings. The components are not necessarily to scale. Also, in the drawings, like reference numerals designate corresponding parts throughout the several views.

FIG. 1, including

FIG. 2, including FIGS. 2A-2C, illustrate various views of an exemplary embodiment of a surface mountable semiconductor die according to the present invention that may be mounted to the header of FIG. 1;

FIG. 3, including

FIG. 4, including

FIG. 5, including FIGS. 5A-5C, illustrate several views that show an embodiment for attaching the trapezoidal die of FIG. 4 to the header of FIG. 1;

FIG. 6, including

FIG. 7 illustrate another alternative embodiment for attaching the trapezoidal die of FIG. 4 to the header of FIG. 1; and FIGS. 8-13 illustrate various steps in an embodiment of a method for manufacturing the "H-design" die 200 of FIG. 2.

DETAILED DESCRIPTION OF THE INVENTION

Figure 1A:
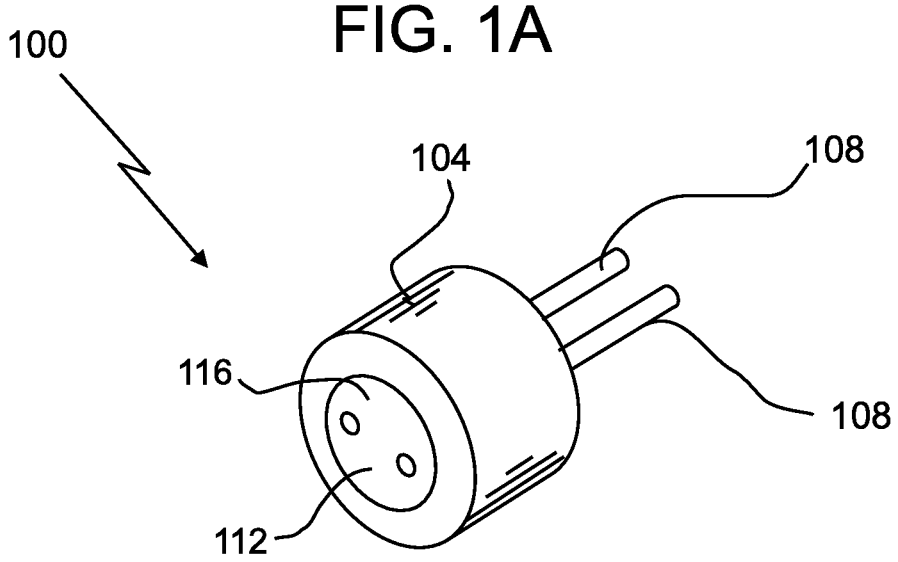
FIGS. 1A-1D, illustrate various views of an exemplary embodiment of a header to which various embodiments of a surface mountable semiconductor bridge ("SCB") die according to the present invention may be connected.
Figure 1B:
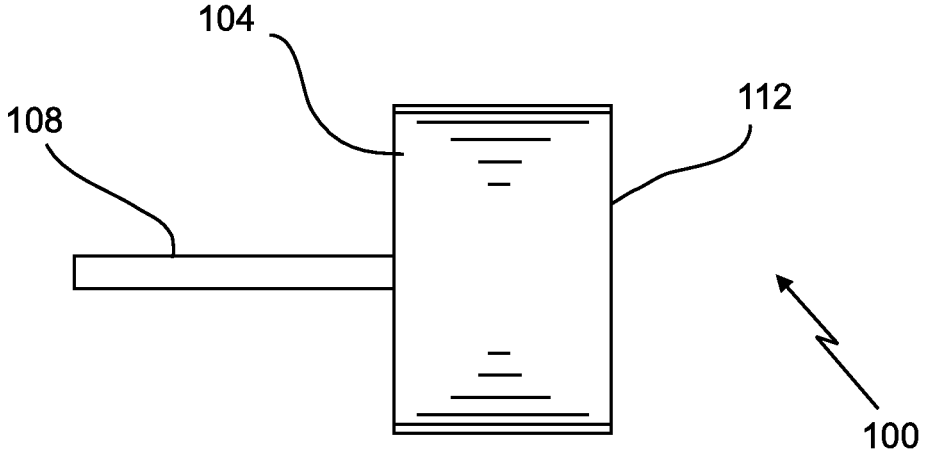
Figure 1C:
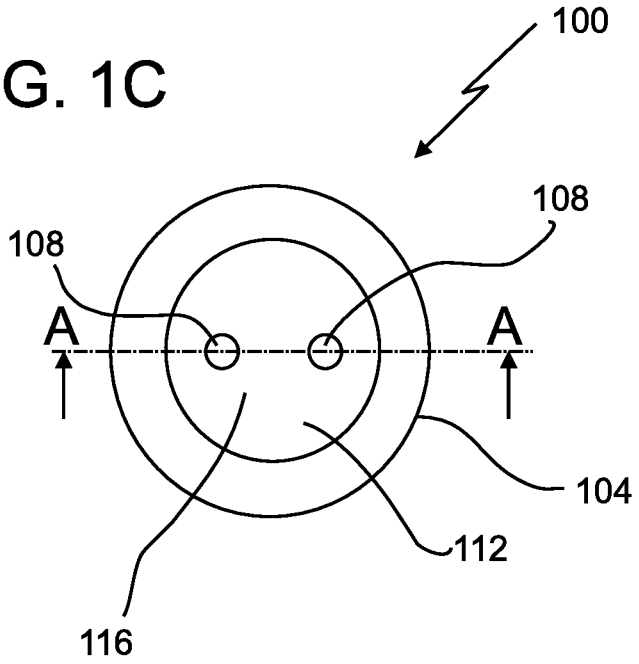
Figure 1D:
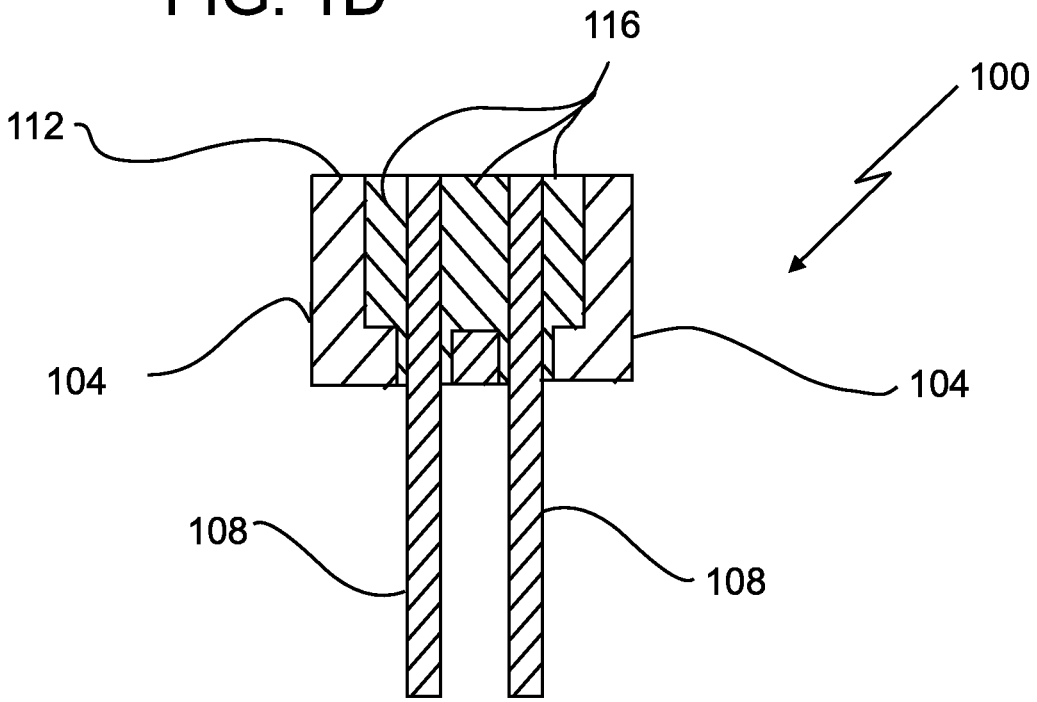

The present invention is more particularly described in the following description and examples that are intended to be illustrative only since numerous modifications and variations therein will be apparent to those skilled in the art. As used in the specification and in the claims, the singular form "a," "an," and "the" may include plural referents unless the context clearly dictates otherwise. Also, as used in the specification and in the claims, the term "comprising" may include the embodiments "consisting of" and "consisting essentially of." Furthermore, all ranges disclosed herein are inclusive of the endpoints and are independently combinable.

As used herein, approximating language may be applied to modify any quantitative representation that may vary without resulting in a change in the basic function to which it is related. Accordingly, a value modified by a term or terms, such as "about" and "substantially," may not to be limited to the precise value specified, in some cases. In at least some instances, the approximating language may correspond to the precision of an instrument for measuring the value.

In an embodiment of the invention, a semiconductor bridge die has an "H-design" configuration in which a center bridge segment is flanked by three angled or sloped walls on each side of the bridge segment. Each wall is plated with a conductive material, thereby providing a continuous conductive path across the top surface of the die. A bottom surface of the die may be connected to a top surface of a header by epoxy in various configurations. The plated angled walls facilitate the solderable connection of the walls to a plated top surface of each of several pins on a top surface of the header, thereby providing a continuous electrical connection between the pins and the die.

In another embodiment of the invention, a semiconductor bridge die has a "trapezoidal" design configuration in which a center bridge segment is flanked by a single angled or sloped wall on each side of the bridge segment. Each wall is plated with a conductive material, thereby providing a continuous conductive path across the top surface of the die. A bottom surface of the die may be connected to a top surface of a header by epoxy in various configurations. The plated angled walls facilitate the solderable connection of the walls to a plated top surface of each of several pins on a top surface of the header, thereby providing a continuous electrical connection between the pins and the die.

According to another aspect of the invention, a method is provided for manufacturing a semiconductor bridge die in accordance with the various embodiments of the die. For example, a difference between the "H-design" and the "trapezoidal" design configurations of the corresponding dies lies in a dicing step in which more of the "trapezoidal" die is removed by dicing than in the "H-design" die configuration.

The foregoing and other features of various disclosed embodiments of the invention will be more readily apparent from the following detailed description and drawings of the illustrative embodiments of the invention wherein like reference numbers refer to similar elements.

Referring to FIG. 1, including FIGS. 1A-1D, there illustrated are various views of an exemplary embodiment of a header 100 to which various embodiments of a surface mountable semiconductor bridge ("SCB") die according to the present invention may be connected, as described in detail hereinafter. The header 100 may comprise metal, glass, ceramic, or other suitable material. The header 100 includes an outer cup 104 and a pair of conductive pins 108. One end of each of the pins 108 is illustrated as being flush with a top surface 112 of the header 100, although the pins 108 may protrude up above the top surface 112 of the header 100 in a suitable amount, if desired. The pins 108 may each comprise an alloyed metal such as the Kovar® nickel-cobalt ferrous alloy, commercially available. The top surface of each of the pins 108 may be gold plated, although other materials may be used as the plating. The gold plating on the top surface of each of the pins 108 may be of a thickness of approximately 50 microinches, which comprises adequate plating for most soldering applications to the pins. However, if a tin/lead solder or a tin/gold solder is used to connect to the pins (as described in detail hereinafter with respect to soldering of the die of FIG. 2 to the pins 108), then the gold plating may be less than 40 microinches in thickness to prevent any embrittlement of the gold that comprises the pin plating. The pins 108 may be electrically isolated from each other and from the outer cup 104 by suitable insulating material 116 located within the cup 104.

Referring to FIG. 2, including FIGS. 2A-2C, there illustrated are various views of an exemplary embodiment of a surface mountable semiconductor die 200 according to the present invention that may be mounted to the header 100 of FIG. 1. In this embodiment, the die 200 may comprise a silicon substrate and may be in the general shape of the letter "H", as best seen in the perspective view of FIG. 2A and the top view of FIG. 2C. FIG. 2B illustrates the die 200 prior to a dicing step during the manufacturing of the die 200. An embodiment of a method for manufacturing the die 200 is described and illustrated in detail hereinafter. In this description of a method embodiment, the various other materials besides the silicon substrate that comprise the die 200 are described.

In the embodiment of FIG. 2, the die 200 includes a centrally located bridge section 204 flanked on either side by a pyramidal-like "half-hole" 208. Each half-hole 208 has a bottom opening portion 212 that is rectangular or square in shape, and is flanked on three sides by tapered or sloped walls 216. In an embodiment, the angle of each of the sloped walls 216 is approximately 55 degrees and may be formed, for example, by an anisotropic potassium hydroxide ("KOH")

etch process through the <100> plane with respect to the top surface of the die 200, as described hereinafter with respect to an exemplary method for manufacturing the die 200.

The surface of each of the angled or sloped walls 216 may be plated with a conductive material, for example, gold, to facilitate the soldered connection of the die 200 to the header 100, as described in detail hereinafter. A relatively thin layer of nickel (e.g., 2.54 um-5.08 um) may be disposed underneath the gold plating. In an embodiment, the solderable plating is present on the walls 216 of the half-holes 208, and the plating is not on the top portion of the die 200, for example, where the bridge segment 204 is located. Also, the plating may be solderable using eutectic or non-eutectic tin/lead solder or using tin/gold solder. The bridge 204 of the die 200 is also in electrical connection with each of the plated half-hole walls 216. Thus, a continuous electrical connection exists across the die 200 from one side to the other (i.e., between the two half-holes 208). Also, in an embodiment, the width of the opening 212 of each of the half-holes 208 is substantially equal to the diameter of the pins 108 at the top surface 112 of the header, as illustrated in more detail in FIG. 3. Note that the width of the openings 212 may be less than or greater than the diameter of the corresponding pins 108.

Figure 3B:
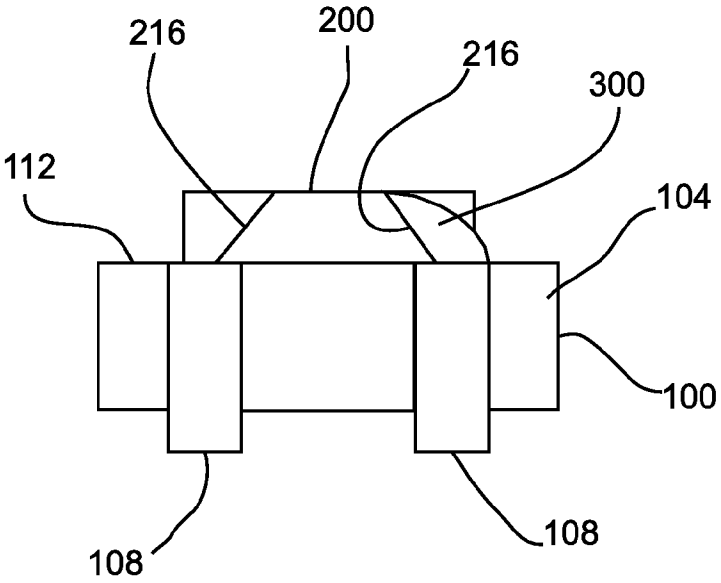
FIGS. 3A and 3B, illustrate top and side views, respectively, of the bottom surface of the H-shaped die of FIG. 2 mounted to the top surface of the header of FIG. 1.
Figure 3A:
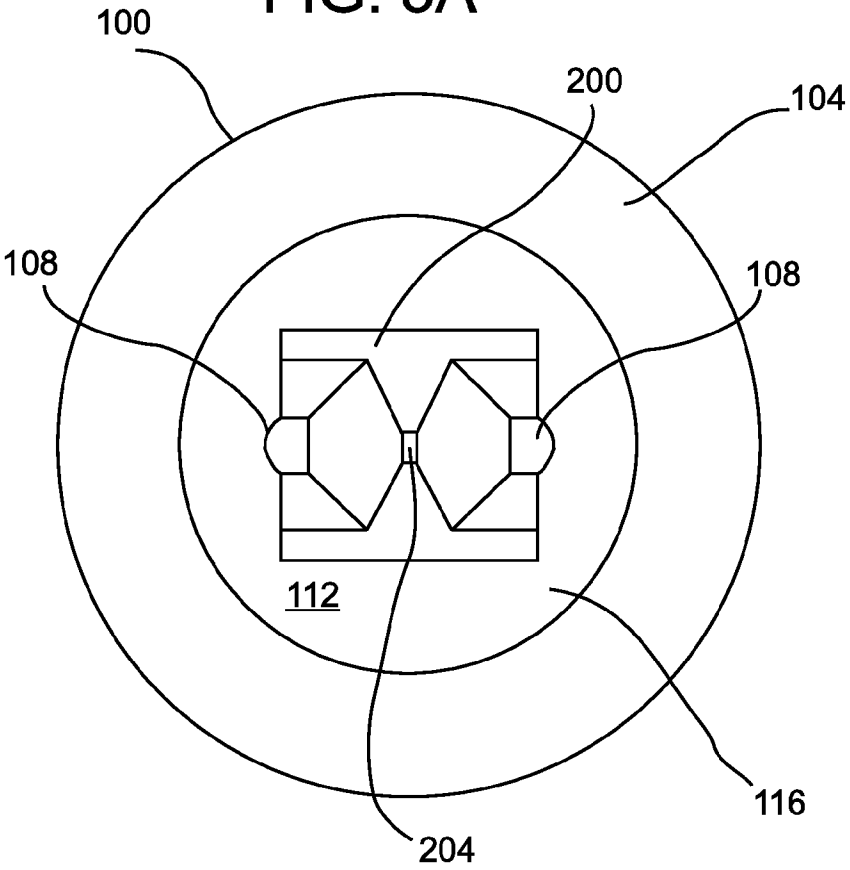

Referring to FIG. 3, including FIGS. 3A and 3B, there illustrated are top and side views, respectively, of the bottom surface of the H-shaped die 200 of FIG. 2 mounted to the top surface 112 of the header 100 of FIG. 1. As described in detail hereinafter, the bottom surface of the die 200 may be mounted to the top surface 112 of the header 100 using, e.g., preferably a non-conductive epoxy, although a conductive epoxy may be used. The die 200 is located on the top surface 112 of the header 100 such that the top surface of each of the pins 108 at the top surface 112 of the header 100 is located within the corresponding half-hole 208, as best seen in FIG. 3A. That is, there exists a "partial inside pitch" of the placement of the half-holes 208 with respect to the pins 108 (e.g., 5 mils from the center of the pin 108), which allows for an amount of placement tolerance of the half-holes 208 with respect to the pins 108. In an embodiment, solder may be used to connect the plated walls 216 of each of the half-holes 208 to the plated top surface of each of corresponding one of the pins 108 of the header. FIG. 3B illustrates one such solder fillet connection 300. As a result, a continuous electrical connection exists between the two pins 108. Various soldering methods may be utilized to effectuate a reliable soldered connection between the die 200 and the header 100. These methods include, for example, a hot air reflow, an infrared reflow, a reflow in forming gas and a hand soldering method using a soldering iron. The infrared reflow method offers advantages such as it allows the surface-mount epoxy to cure within the same process as the solder paste. Also, it is relatively less labor intensive than the hot air reflow method of the hand soldering iron method.

As noted hereinabove, the die 200 and header 100 device combination may be utilized as a bridge igniter device in which the bridge 204 of the die 200 is in contact with a reactive or explosive material such as a pyrotechnic charge. The pins 108 of the header may have an electrical power source connected across the pins 108 such that when an electrical current is applied through the bridge 204 an initiation or ignition of the reactive or explosive material occurs, which effect may then be used to trigger a detonator device connected further downstream of the reactive or explosive material by, e.g., a shock tube.

Figure 4A:
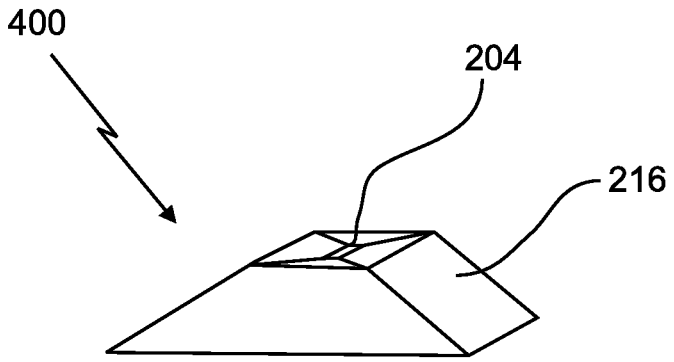
FIGS. 4A and 4B, illustrate, respectively, a perspective view of an alternative embodiment of a surface mountable semiconductor die according to the invention and a top view of the die of FIG. 4A mounted to the top surface of the header of FIG. 1.
Figure 4B:
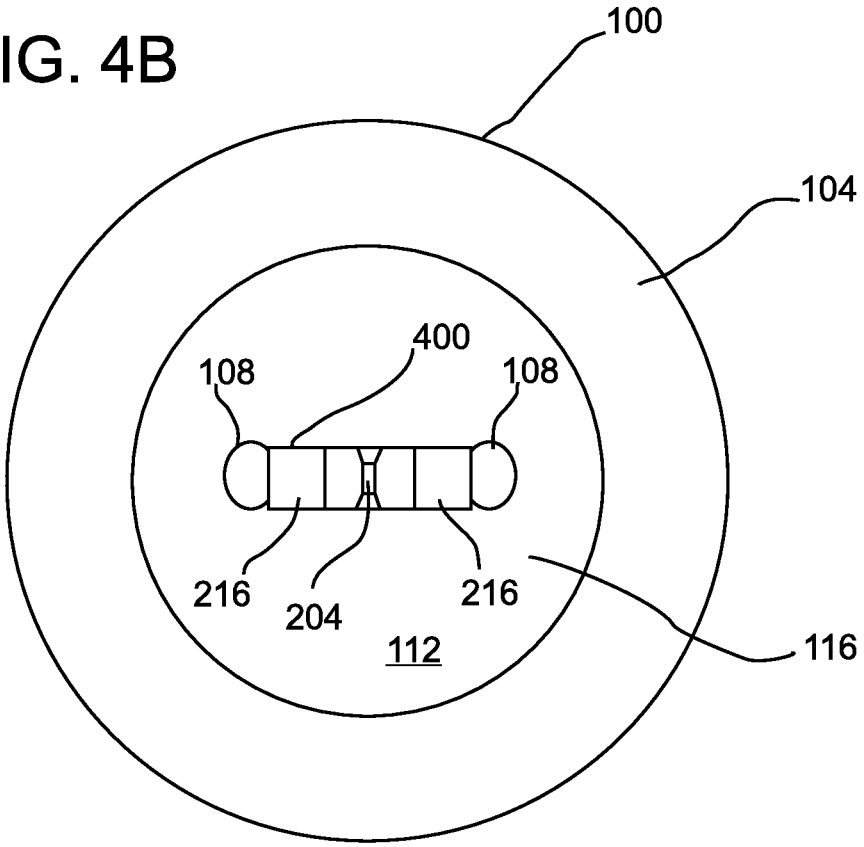

Referring to FIG. 4, including FIGS. 4A and 4B, there illustrated, respectively, is a perspective view of an alternative embodiment of a surface mountable semiconductor die 400 according to the invention and a top view of the die 400 of FIG. 4A mounted to the top surface of the header 100 of FIG. 1. The embodiment of the die 400 of FIG. 4A is somewhat similar to the die 200 of FIG. 2, except that the portions of the die 200 of FIG. 2 forming the "legs" of the H-design are eliminated during the manufacturing thereof by, e.g., dicing. This results in a "trapezoidal" design in which only one angled or sloped wall 216 exists on either side of the die 400, with the bridge segment 204 centered therebetween. Similar to the die 200 of FIG. 2, the die 400 of FIG. 4A may be plated with a conductive material such that the bridge segment 204 is in continuous electrical contact with the sloped walls 216.

FIG. 4B illustrates the die 400 of FIG. 4A connected to the header 100 of FIG. 1. As with the die 200 of FIG. 2, the bottom surface of the die 400 of FIG. 4 may be connected to the top surface 112 of the header 100 by epoxy. The die may be located such that the outer end of each of the walls 216 is disposed slightly over a portion of the corresponding pin 108. Also, as shown in FIG. 4B, the width of each of the walls 216 is substantially equal to the diameter of the corresponding pin 108. However, the width of the walls 216 may be less than or greater than the diameter of the corresponding pins 108. Although not shown in FIG. 4B, the plated top surface of each of the pins 108 may be connected to the corresponding plated conductive wall 216 of the die 400 by soldering. That is, the solder fillet 300 of FIG. 3B may be utilized, although not shown in FIG. 4B. The "trapezoidal" embodiment of the die 400 in FIG. 4 has an advantage over the "H-design" embodiment of the die 200 of FIG. 2 in that, in practice, it has been found to be somewhat difficult to adequately place epoxy on the bottom surface of the die 200 at the locations of the "legs" of the "H-design" die 200 of FIG. 2 to effectuate a proper contact between the bottom surface of the die 200 and the top surface 112 of the header 100 at those locations. This may lead to breakage of the die 200 during a powder processing step.

Thus, as seen from FIGS. 2-4, two different configurations (i.e., "H-design", "trapezoidal") for the die 200, 400 can be obtained from a single wafer depending upon how it is diced.

Referring to FIG. 5, including FIGS. 5A-5C, there illustrated are several views that show an embodiment for attaching the trapezoidal die 400 of FIG. 4 to the header 100 of FIG. 1. The attachment is achieved using an epoxy 500 on both the bottom surface of the die 400 and the top surface 112 of the header 100 such that the epoxy 500 substantially fills in the bottom surface of the die 400. In this embodiment, typically a peripheral fillet of the epoxy 500 results. As such, the solder fillet 300 will need to bridge the epoxy fillet, as shown in FIG. 5C. Preferably, the epoxy 500 may be stamped to limit the epoxy fillet size and also the amount of spreading of the epoxy 500. When using the epoxy in its uncured state, suitable tooling may be utilized to spread the epoxy 500 in a relatively even film prior to adhering the die 200, 400 and header 100 together.

Figure 6A:
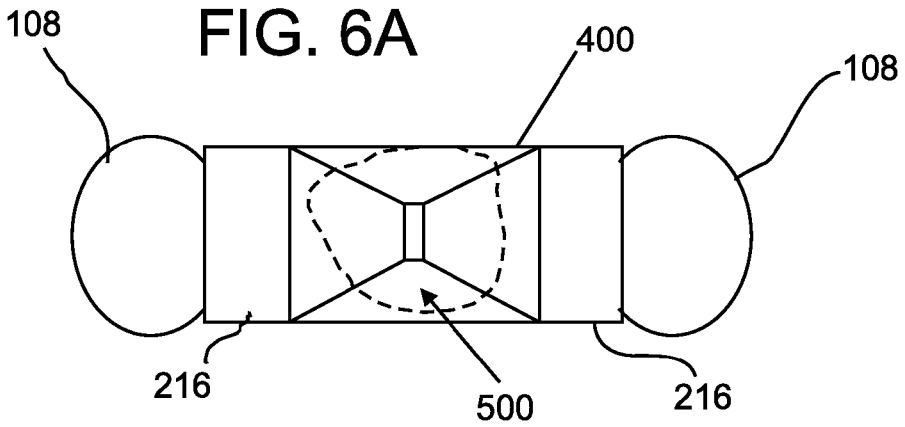
FIGS. 6A-6C, illustrate several views that show an alternative embodiment for attaching the trapezoidal die of FIG. 4 to the header of FIG. 1.
Figure 6B:
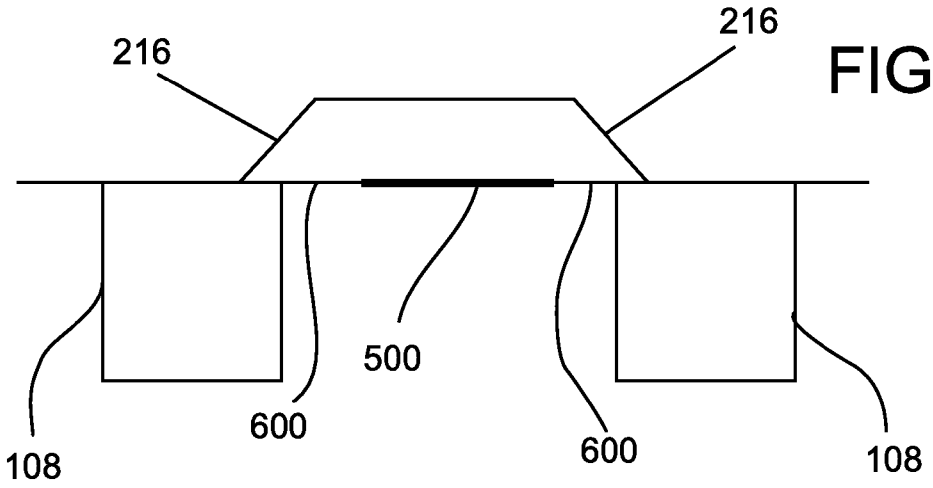
Figure 6C:
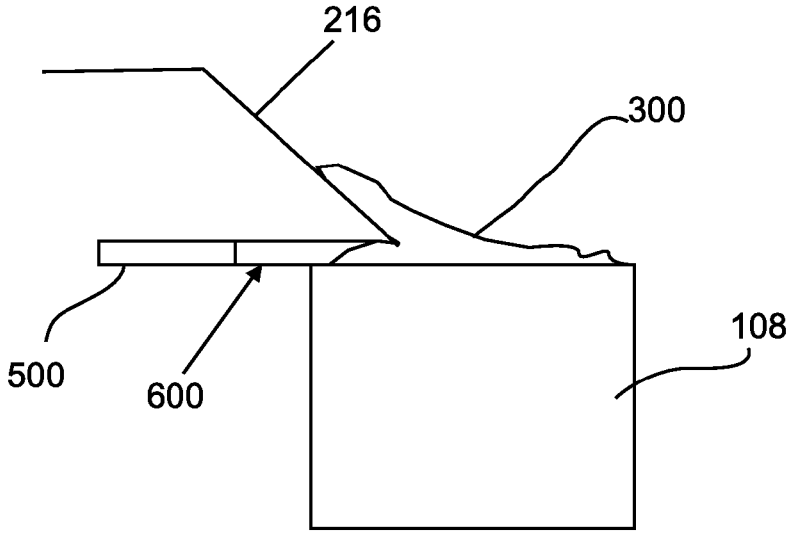

Referring to FIG. 6, including FIGS. 6A-6C, there illustrated are several views that show an alternative embodiment for attaching the trapezoidal die 400 of FIG. 4 to the header 100 of FIG. 1. In this embodiment, not only are the angled walls 216 of the die 400 plated, but the plating is extended to wrap around to the bottom surface of the die 400 and extend along a portion thereof, for example, to just to the left side end of the pin 108 in FIG. 6C. As such, the solder fillet 300 is also extended to be located underneath the bottom surface of the die 400 such that it is substantially equal to the left end side of the pin 108 in FIG. 6C. Thus, in this embodiment, the epoxy 500 is placed in a relatively small "dot" only between the pins 108 and, after it is spread by, e.g., the tooling, the epoxy 500 does not completely underfill the bottom surface of the die 400, as shown in FIGS. 6A and 6B. This results in two small gaps 600 on the bottom surface of the die 400 where the epoxy 500 ends and the pins 108 began. These gaps 600 may cause breakage of the die 400 under a loading force.

As an alternative to the use of a small "dot" of epoxy, a stamped epoxy die or an epoxy perform may be utilized. In this embodiment, the die 400 is stamped into a stripe 700 of epoxy 500, as shown in FIG. 7. This embodiment may be utilized for the trapezoidal die 400 of FIG. 4 and is similar to the embodiment of FIG. 6 in that the epoxy 500 is located between the pins 108 and the plating may extend to a portion of the bottom surface of the die 400. In still another embodiment, a conductive epoxy may be utilized solely on the plating on top of the pins 108 to adhere to the bottom surface of the die 200, 400.

In any of the embodiments of the epoxy 500, a relatively high temperature epoxy that is compatible with the soldering process may be utilized. That is, the epoxy 500 preferably does not contaminate the solder joints and the epoxy cures within the reflow process prior to solder paste reflow.

Figure 9A:
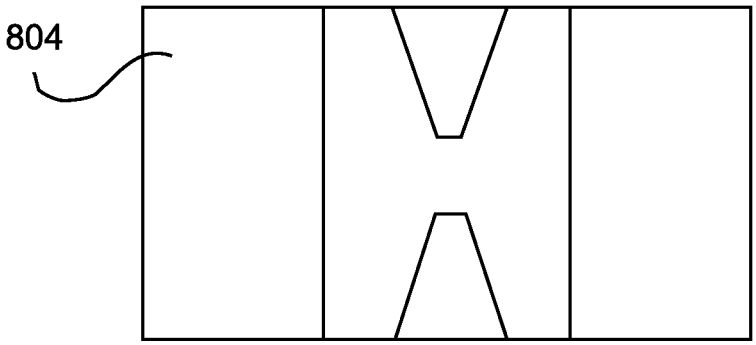
Figure 9B:
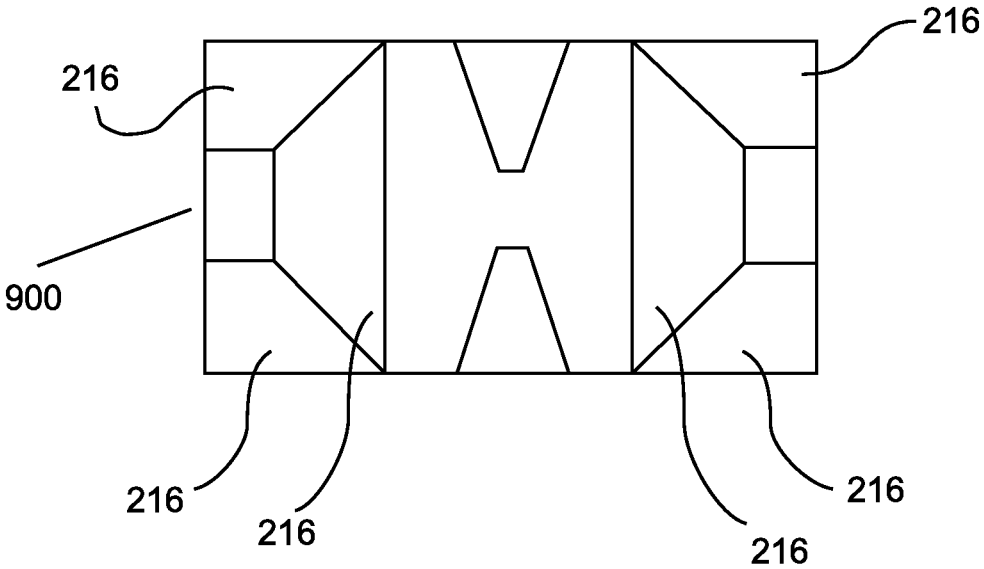
Figure 10A:
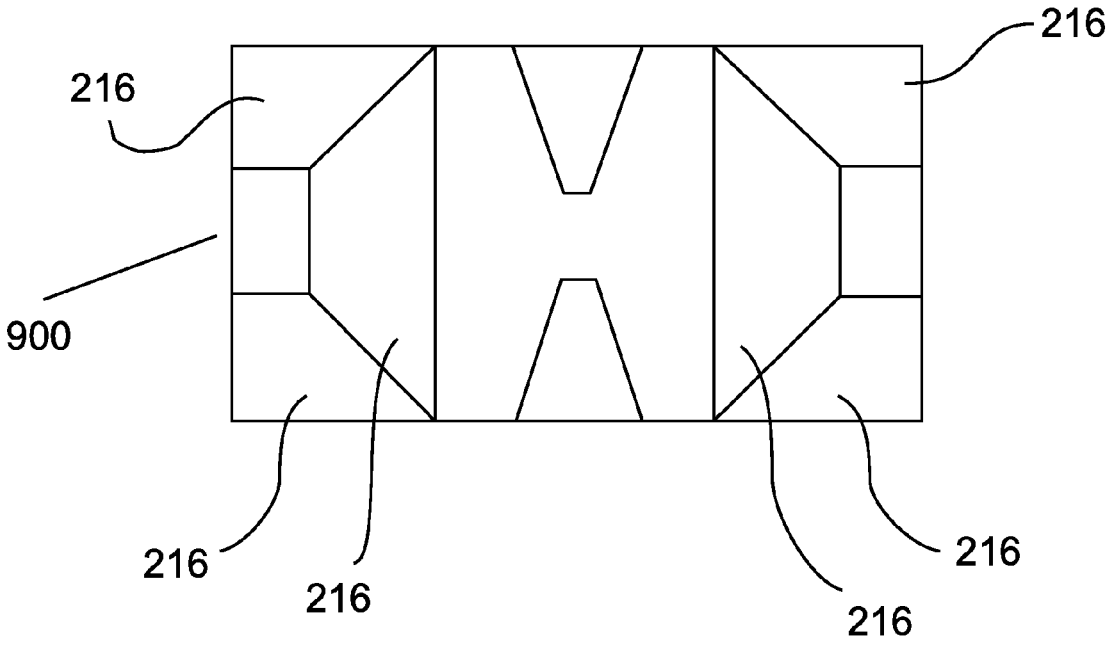
Figure 10B:
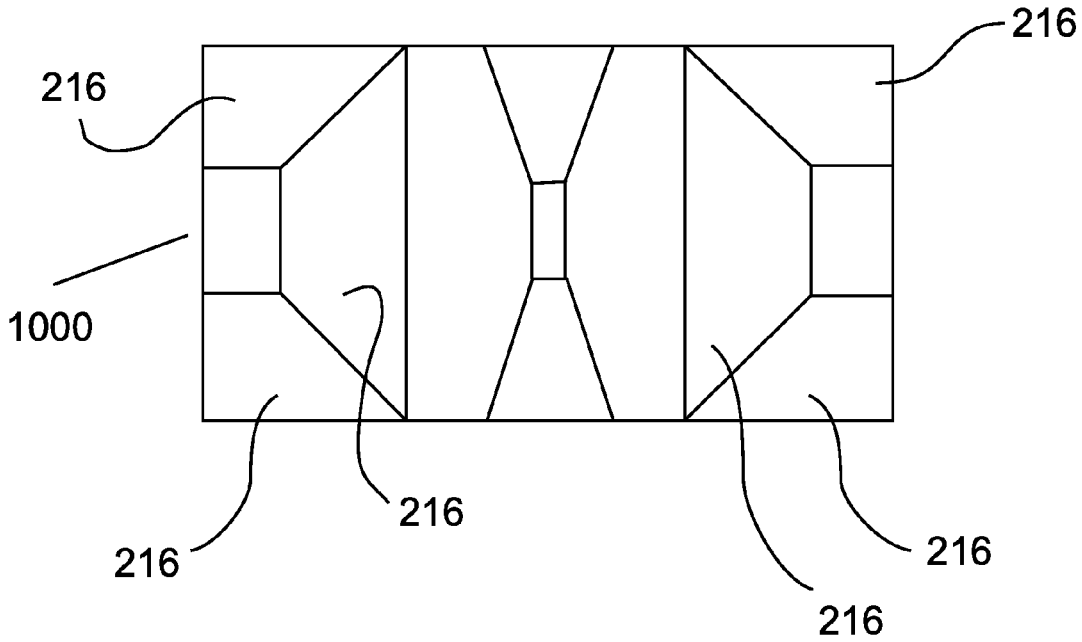
Figure 11A:
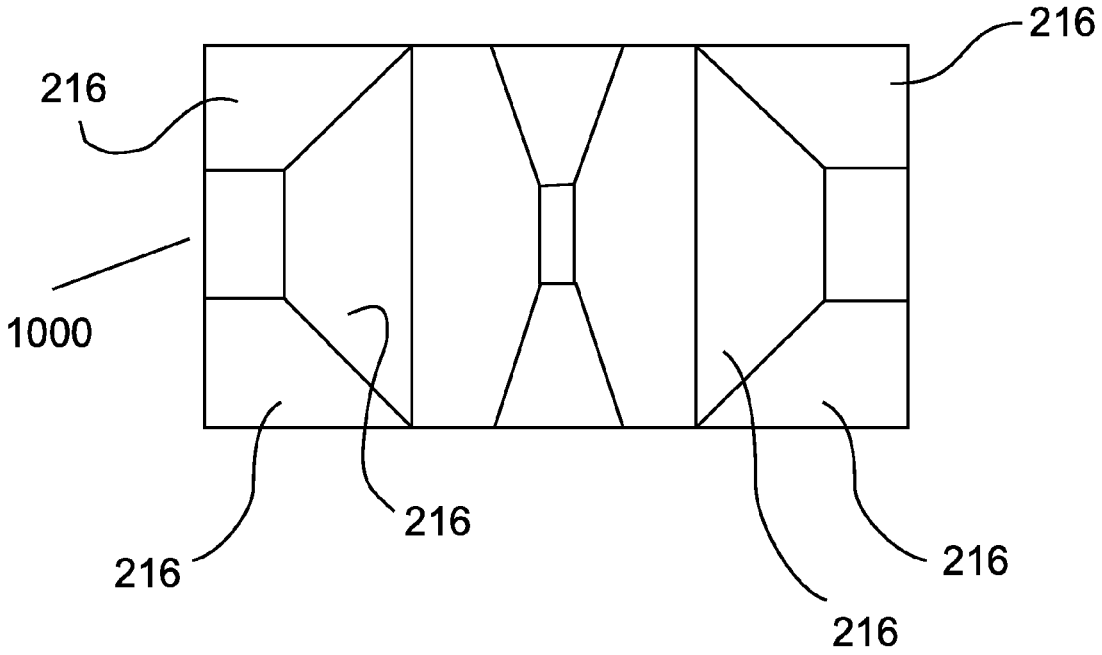
Figure 11B:
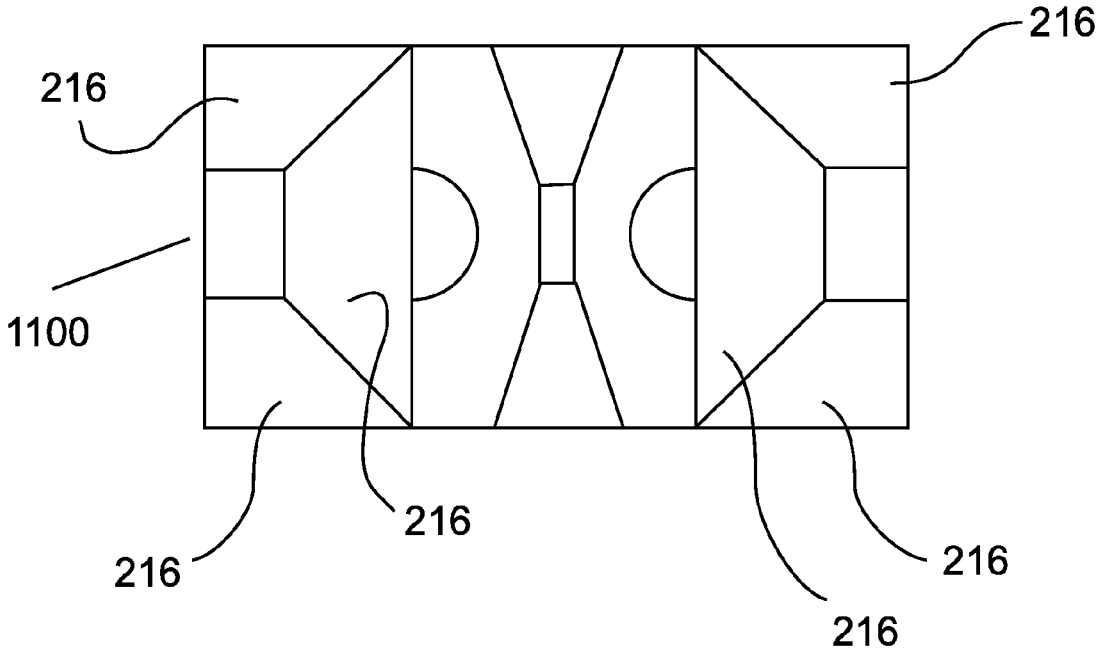
Figure 12A:
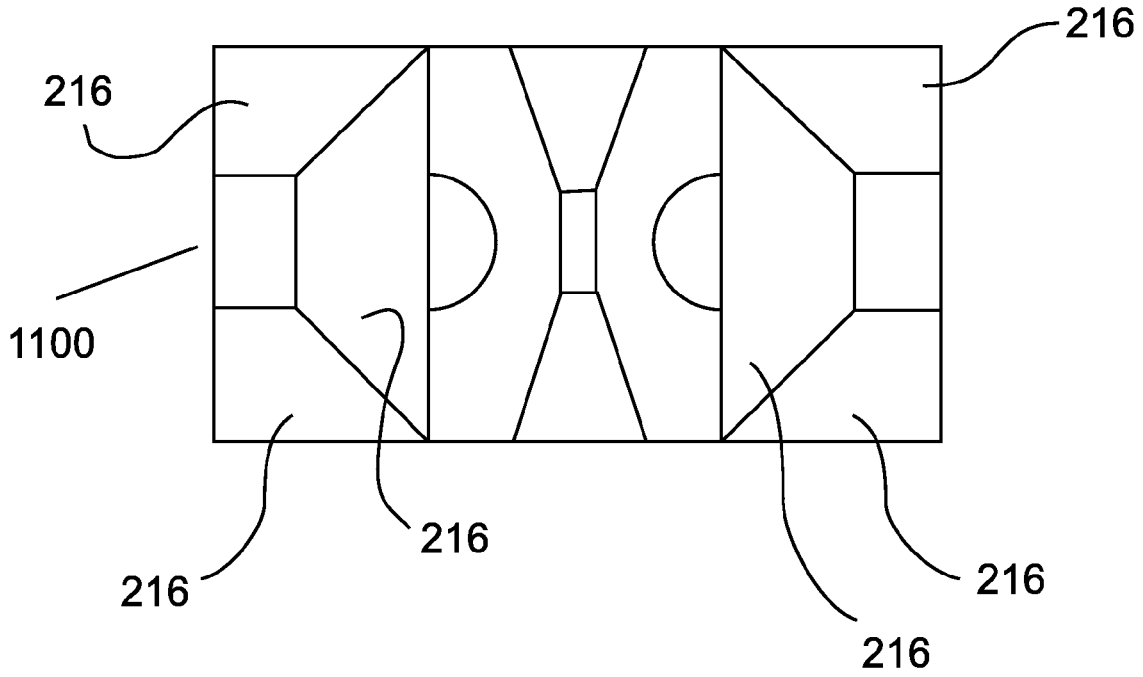
Figure 12B:
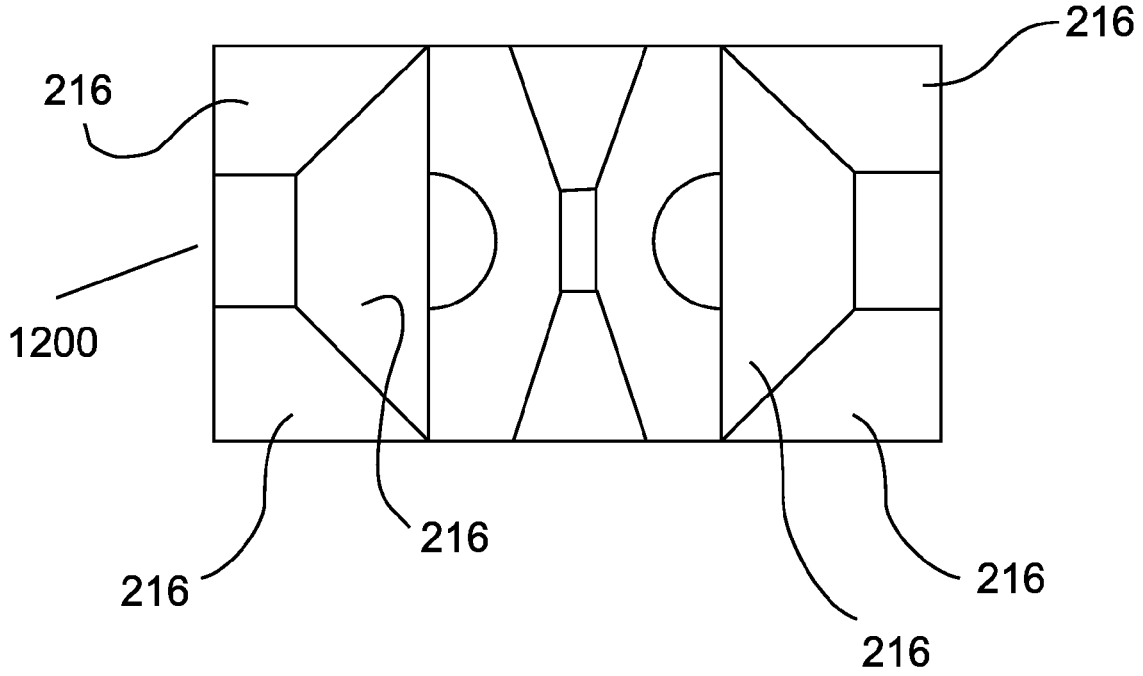
Figure 13A:
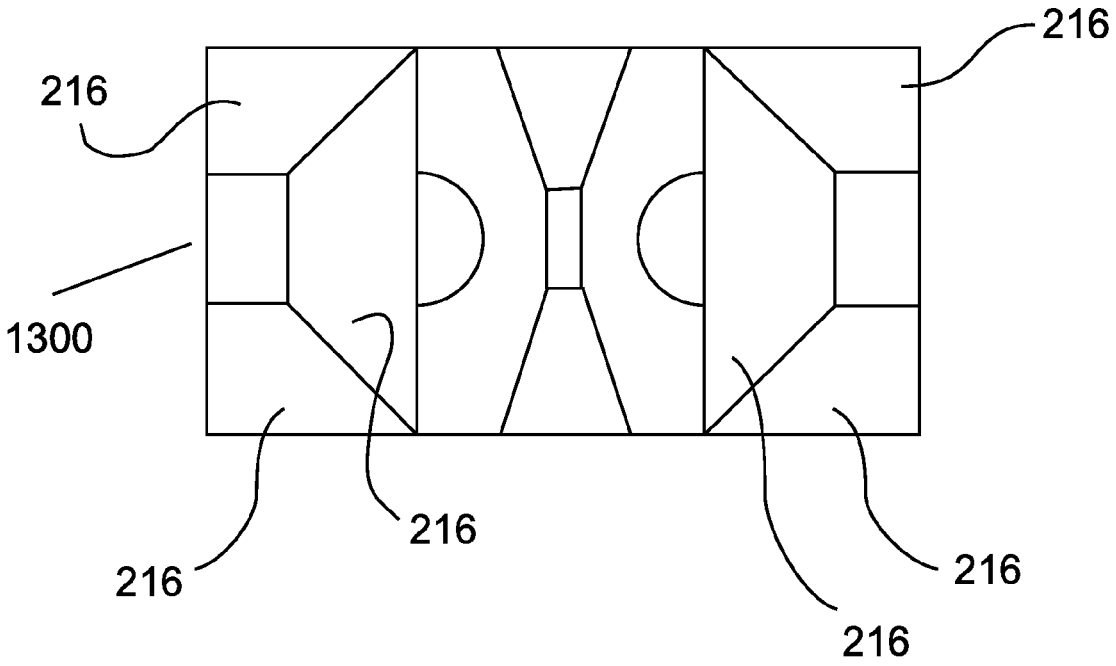
Figure 13B:
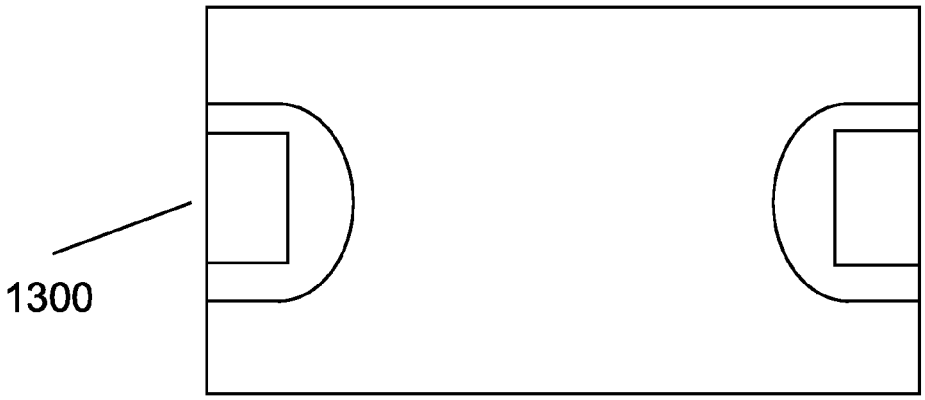

Referring to FIGS. 8-13, there illustrated are various steps in an embodiment of a method for manufacturing the "H-design" die 200 of FIG. 2. Referring to FIG. 8, the "baseline layer stack-up" of the die 200 starts with the silicon wafer substrate having a relatively thin layer of silicon dioxide (e.g., 0.6-0.8 um) disposed on top and a relatively thin layer of polysilicon (e.g., 1.8 um-2.2 um) deposited on the silicon dioxide layer. The resulting substrate 800 is shown in the upper figure in FIG. 8. Then, using a polysilicon mask, the polysilicon is etched away, resulting in the substrate 804 in the lower figure of FIG. 8. In FIG. 9, the upper figure is the substrate 804, while the lower figure is the substrate 900 after the angled walls 216 have been formed through use of an etching process. A nitride mask is used to protect the polysilicon during the etching process. In FIG. 10, the upper figure is the substrate 900, while the lower figure shows the substrate 1000 after the aluminum lands have been added. This may be performed by coating the entire wafer with aluminum and, using an alands mask, the aluminum is etched to form the lands. The aluminum may have a thickness of 10,000-15,000 angstroms. In FIG. 11, the upper figure is the substrate 1000, while the lower figure shows the substrate 1100 after the walls 216 have been plated with gold using a gpad mask. In FIG. 12, the upper figure is the substrate 1100, while the lower figure shows a substrate 1200 with the addition of a passivation layer using a passivation mask. In FIG. 13, the upper figure shows the front side of the substrate 1300 with back side metallization (Au/Ni/Tn), while the lower figure shows the back side of the substrate 1300.

Embodiments of the invention provide for the elimination of bondwires or epoxy to electrically connect the SCB die to the header. Embodiments of the invention also provide for a relatively more reliable and easier solderable connection of the SCB die to the header. Also due to the design of the SCB die, its dimensional requirements are relaxed and, thus, the cost of the header is less.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

We claim:

1. An explosive initiator device, comprising:

a semiconductor bridge die having a substrate having a bridge section and a first wall and a second wall, wherein the bridge section is in electrical connection with the first wall and the second wall;

an electrically conductive plating disposed on the first wall and second wall; and a header that is in physical connection with the semiconductor bridge die, wherein the header has a first electrically conductive pin disposed adjacent to and in electrical connection with the first wall of the semiconductor bridge die, and wherein the header has a second electrically conductive pin disposed adjacent to and in electrical connection with the second wall of the semiconductor bridge die;

wherein the first wall and second wall extend from the bridge towards a surface of the header and are arranged on an angle greater than 90 degrees relative to the surface of the header.

2. The explosive initiator device of claim 1, wherein the electrical connection between the first pin of the header and the first wall of the semiconductor bridge die comprises a soldered connection between a surface of the first pin of the header and a surface of the first wall of the semiconductor bridge die, and wherein the electrical connection between the second pin of the header and the second wall of the semiconductor bridge die comprises a soldered connection between a surface of the second pin of the header and a surface of the second wall of the semiconductor bridge die.

3. The explosive initiator device of claim 1, wherein the physical connection between the header and the semiconductor bridge die comprises an epoxy connection between a surface of the header and a surface of the semiconductor bridge die.

4. The explosive initiator device of claim 3, wherein the epoxy connection comprises an epoxy connection between at least a portion of a bottom surface of the semiconductor bridge die and a portion of a top surface of the header.

5. The explosive initiator device of claim 3, wherein the epoxy connection comprises an epoxy connection between an entire portion of a bottom surface of the semiconductor bridge die and a portion of a top surface of the header.

6. The explosive initiator device of claim 1, wherein the first wall has a pair of opposing walls disposed adjacent the first wall, wherein the second wall has a pair of opposing walls disposed adjacent the second wall, wherein the pair of opposing walls disposed adjacent the first wall are downward from a top of the substrate towards a bottom of the substrate, wherein the pair of opposing walls disposed adjacent the second wall are downward from a top of the substrate towards a bottom of the substrate, wherein the semiconductor bridge die has an H shape.

7. The explosive initiator device of claim 6, wherein each one of the pair of opposing walls disposed adjacent the first wall has a conductive plating on a surface thereof, and wherein each one of the pair of opposing walls disposed adjacent the second wall has a conductive plating on a surface thereof, wherein the bridge section is also in electrical connection with the pair of opposing walls disposed adjacent the first wall and with the pair of opposing walls disposed adjacent the second wall.

8. The explosive initiator device of claim 7, wherein the header has the first electrically conductive pin in soldered electrical connection with the conductive plating of the first wall of the semiconductor bridge die and with the conductive plating of each one of the pair of opposing walls disposed adjacent the first wall, and wherein the header has the second electrically conductive pin in soldered electrical connection with the conductive plating of the second wall of the semiconductor bridge die and with the conductive plating of each one of the pair of opposing walls disposed adjacent the second wall.

9. The explosive initiator device of claim 8, wherein a first opening is formed in the semiconductor bridge die where a bottom portion of each one of the pair of opposing walls disposed adjacent the first wall and a bottom portion of the first wall are located, wherein the header has the first electrically conductive pin located in the first opening and in soldered electrical connection with the conductive plating of the first wall of the semiconductor bridge die and with the conductive plating of each one of the pair of opposing walls disposed adjacent the first wall, and wherein a second opening is formed in the semiconductor bridge die where a bottom portion of each one of the pair of opposing walls disposed adjacent the second wall and a bottom portion of the second wall are located, wherein the header has the second electrically conductive pin located in the second opening and in soldered electrical connection with the conductive plating of the second wall of the semiconductor bridge die and with the conductive plating of each one of the pair of opposing walls disposed adjacent the second wall.

10. The explosive initiator device of claim 1, wherein the first wall and the second wall are both angled downward from a top of the substrate towards a bottom of the substrate, wherein the bridge section is located between the first wall and the second wall, wherein the semiconductor bridge die has a trapezoidal shape, and wherein the first wall and the second wall each has a conductive plating formed on a surface thereof.

* * * * *